US007520541B1

(12) United States Patent
Lawrence

(10) Patent No.: US 7,520,541 B1
(45) Date of Patent: Apr. 21, 2009

(54) TILT LATCH

(76) Inventor: Barry G. Lawrence, 1515 Johnsontown Rd., Thomasville, NC (US) 27360

( * ) Notice: Subject to any disclaimer, the term of this patent is extended or adjusted under 35 U.S.C. 154(b) by 263 days.

(21) Appl. No.: 11/274,540

(22) Filed: Nov. 15, 2005

(51) Int. Cl.
*E05C 1/10* (2006.01)

(52) U.S. Cl. ..... 292/175; 292/DIG. 47; 49/449

(58) Field of Classification Search ..... 292/DIG. 31, 292/175, 337; 49/449, 161, 176, 183–185
See application file for complete search history.

(56) References Cited

U.S. PATENT DOCUMENTS

| | | | | |
|---|---|---|---|---|
| 4,400,026 | A * | 8/1983 | Brown, Jr. | 292/175 |
| 4,533,353 | A * | 8/1985 | Akiyama | 604/321 |
| 5,028,083 | A * | 7/1991 | Mischenko | 292/175 |
| 5,139,291 | A | 8/1992 | Schultz | 292/42 |
| 5,219,195 | A | 6/1993 | Lawrence | 292/336.3 |
| 5,536,052 | A | 7/1996 | Maier | 292/63 |
| 5,669,180 | A | 9/1997 | Maier | 49/181 |
| 5,669,639 | A | 9/1997 | Lawrence | 292/175 |
| 5,970,656 | A | 10/1999 | Maier | 49/181 |
| 5,996,283 | A | 12/1999 | Maier | 19/181 |
| 6,068,306 | A | 5/2000 | Brautigam | 292/242 |
| 6,142,541 | A | 11/2000 | Rotondi | 292/241 |
| 6,450,554 | B1 | 9/2002 | Rotondi et al. | 292/158 |
| 6,568,723 | B2 | 5/2003 | Murphy et al. | 292/241 |
| 6,660,427 | B1 * | 12/2003 | Hukill et al. | 429/97 |
| 6,722,712 | B2 * | 4/2004 | Schultz | 292/175 |
| 6,767,038 | B1 | 7/2004 | Huml | 292/158 |
| 6,871,886 | B2 | 3/2005 | Coleman et al. | 292/241 |

OTHER PUBLICATIONS

U.S. Appl. No. 11/110,172, filed Apr. 20, 2005, Barry G. Lawrence.
U.S. Appl. No. 11/136,066, filed May 24, 2005, Barry G. Lawrence.
U.S. Appl. No. 10/867,370, filed Jun. 14, 2004, Lyn O. Trickel.

* cited by examiner

*Primary Examiner*—Gary Estremsky

(57) ABSTRACT

A tilt latch for pivotable window sashes is preferably integrally molded from a durable polymeric material but can also be made from metals, metal alloys or the like. The latch includes an angled projection for engaging a recess in the window frame and includes a central body having a cavity for containing a coil spring. Upper and lower covers overhang the sides of the body to form channels for engaging the edge of the sash groove.

16 Claims, 5 Drawing Sheets

TILT LATCH

FIELD OF THE INVENTION

The invention herein pertains to pivotal window sashes and particularly pertains to latches which maintain the pivotal sashes in a closed posture.

DESCRIPTION OF THE PRIOR ART AND OBJECTIVES OF THE INVENTION

Windows having pivotable or "tilt" sashes have become widely accepted in recent years due to improved mass production techniques, hardware and other innovations. Tilt windows can be easily cleaned from inside the house or building and are often left open during light rainfall to provide fresh air to the occupants. Conventional pivotal sashes utilize a pair of latches at opposing ends of the top frame member which are manually operated to open the sash. Standard sash latches as shown in U.S. Pat. Nos. 5,139,291 and 5,669,639 are generally spring operated and engage catches or recesses along the sides of the window frame when closed. Some conventional latches create openings along the latch top when the latch is operated, exposing the interior features such as springs, slides and the like. Dust, debris and moisture can penetrate the opening to jam or foul the latch mechanism. Also, some conventional sash latches require a mounting slot to be cut to exacting standards in the top of the sash for the latch to properly operate. Other standard latches employ an internal spring which requires detailed, labor intensive latch assembly. Should these springs become weak or broken during use they are difficult to repair and maintain, rendering the latch useless.

Thus in view of the problems and disadvantages of conventional window sash tilt latches, the present invention was conceived and one of its objectives is to provide a simple tilt latch in which little assembly is required.

It is another objective of the present invention to provide a tilt latch which can easily be fitted with a spring by unskilled persons.

It is another objective of the present invention to provide a tilt latch which operates in a variety of sash slots formed with large tolerances.

It is still another objective of the present invention to provide a tilt latch that can be easily inserted or removed from the window sash without special tools or equipment.

It is yet another objective of the present invention to provide a tilt latch in which the spring can be quickly removed and replaced after the latch is mounted in a window sash.

It is a further objective of the present invention to provide a tilt latch that is relatively inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing a tilt latch preferably molded as one part from a standard, rigid, durable glass reinforced nylon and includes a cavity for maintaining a spring. By forming the latch in one piece a stronger, more durable latch is achieved for performing at higher sash pressure ratings. The latch includes a body having a front, angled projection. Upper and lower covers sandwich the body, slightly overhanging the body sides and are substantially coplanar with the outer surfaces of the angled projection. The projection engages a recess in the window frame to secure the sash when it is closed. Mirror image left and right tilt latches are formed for the respective sides of the window sash to mount within grooves on opposing sides of the top of the sash. Ramps on each side of the lower cover assist in the insertion of the latch into the sash groove.

The upper and lower covers extend beyond or overhang the sides of the body to provide channels for engaging the edges of the groove formed in the top of the window sash. Ramps on each side of the latch slightly, temporarily distort or spread the groove during latch insertion. The groove is positioned in the top of a sash tubular frame member as conventional. The upper cover of the tilt latch includes a top finger tab and extends rearwardly beyond the body parallel to the lower cover. Opposing channels are formed in the rear of the upper and lower covers to guide and maintain a resilient member such as a coil spring in a stable position proximate the spring cavity in the body. A spring can thus be inserted through the channels into the cavity of the body before mounting the latch into the sash groove. Shoulders formed by the upper and lower covers proximate the projection stop and prevent the latch from escaping the sash groove once the latch is installed as the spring normally urges the latch outwardly. The lower cover shoulders adjacent the ramps abut the inside edges of the sash. The upper cover shoulders abut gates positioned on modified sashes to provide additional strength and latch integrity. The projection extends beyond the side of the sash when the sash is open. The finger tab can be used to retract the latch, such as when opening or closing the sash.

As the sash is rotated towards the window frame the extended latch projections strike the jamb edges and due to the angled configuration of the projections, the jamb edges urge the latches (retract the latches) deeper into the sash grooves. Once the sash is completely closed the latch projections then extend outwardly into the window frame or jamb recesses to secure the window sash in its closed posture with the projections fully seated in the recesses as usual.

DETAILED DESCRIPTION OF THE PREFERRED EMBODIMENT AND OPERATION OF THE INVENTION

Figure 1:
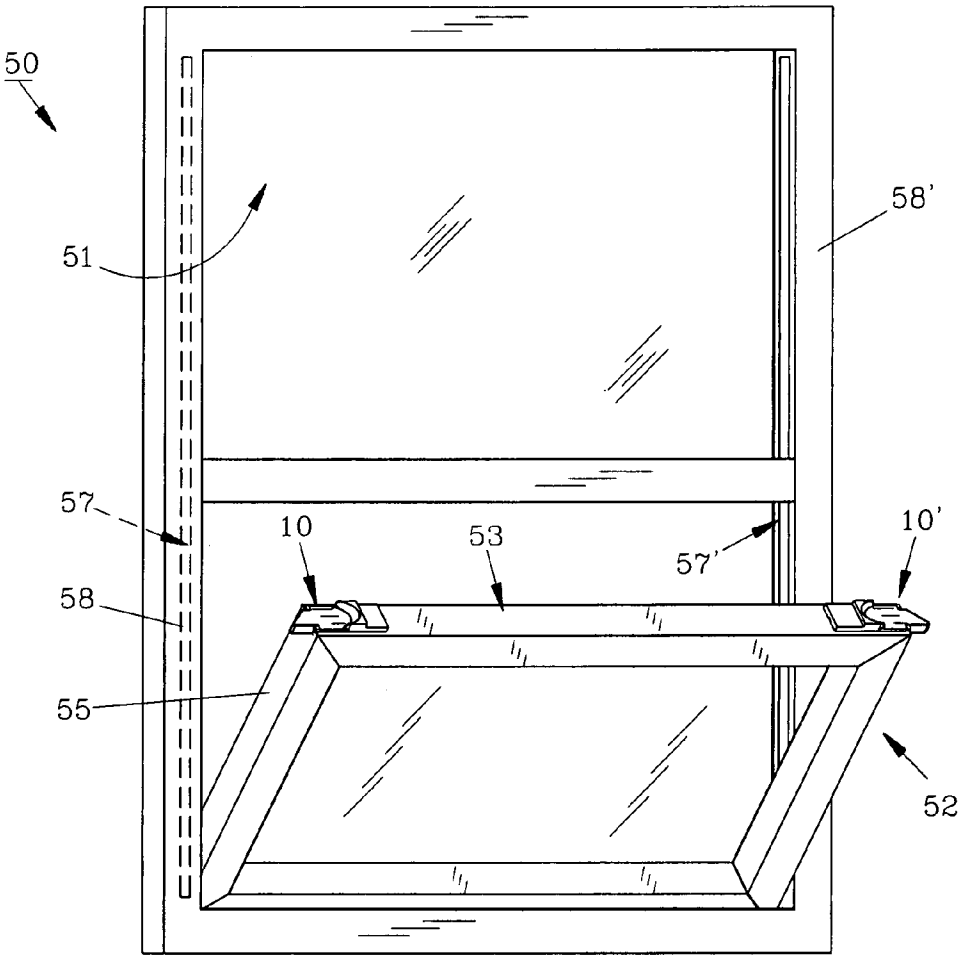
FIG. 1 shows a typical pivotal window with tilt latches of the invention positioned along the top of the pivotal sash.

For a better understanding of the invention and its operation, turning now to the drawings, FIG. 1 shows typical tilt window 50 as used in exterior walls of houses and other buildings. Window 50 includes side frame members 58, 58' with respectively tilt latch frame recesses 57, 57' therein, fixed upper window sash 51 and lower pivotable or tiltable window sash 52. Conventional windows are often manufactured with two or more tiltable sashes and are well known in the trade.

As further seen in FIG. 1, pivotable sash 52 comprises upper frame member 53 having sash grooves 54 (FIG. 5), 54' (54' not shown) and side frame member 55. A pair of preferred tilt latches 10, 10' are shown mounted thereon, each of which slide in respectively grooves 54, 54' also seen enlarged in FIGS. 5 and 6. As would be understood, tilt latches 10, 10' are mirror images, for mounting in respectively grooves 54, 54' formed in the left and right sides of sash 52 as seen in FIG. 1.

Figure 7:
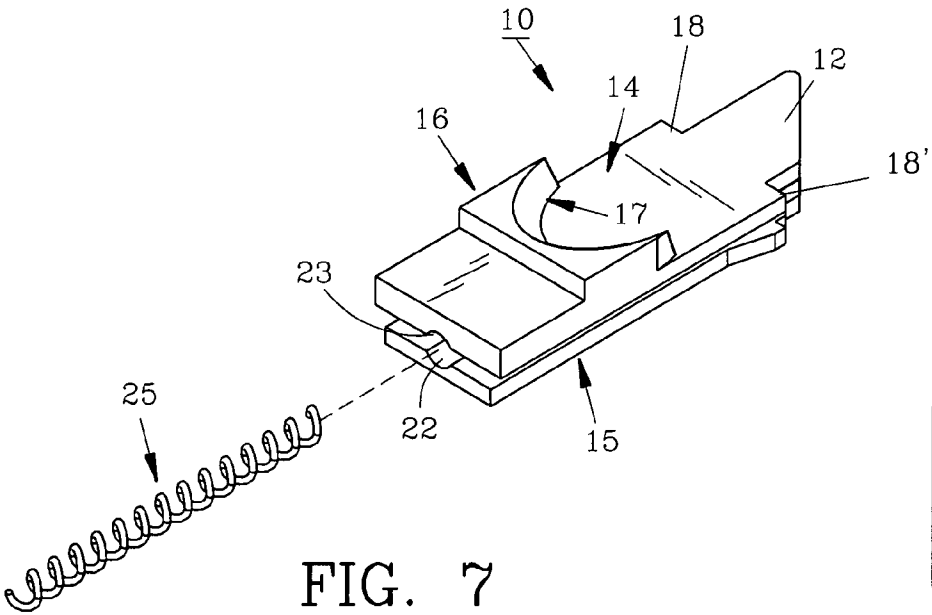
FIG. 7 depicts a rear perspective view of the preferred tilt latch of the invention removed from the sash and with the spring exploded therefrom.
Figure 10:
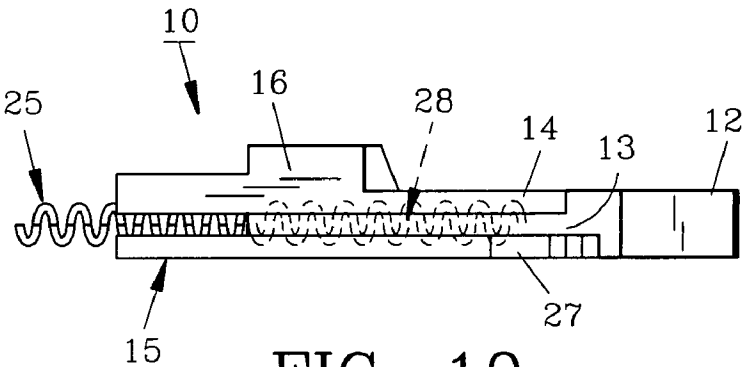
FIG. 10 shows a right side elevational view of the tilt latch with the spring mounted therein.

As seen in FIG. 10, tilt latch 10 comprises body 13 having cavity 28 (also seen in FIG. 4) therein, upper cover 14 having shoulders 18, 18' (FIG. 7), lower cover 15 with shoulders 19, 19' (FIG. 12) and projection 12. As seen in FIG. 7, upper cover 14 and lower cover 15 include respectively upper channel 23 and lower channel 22 for receiving and maintaining coil spring 25 therein. Tilt latch 10 also includes top finger tab 16 with arcuate face 17 for manipulation of latch 10 when opening or closing sash 52.

Figure 2:
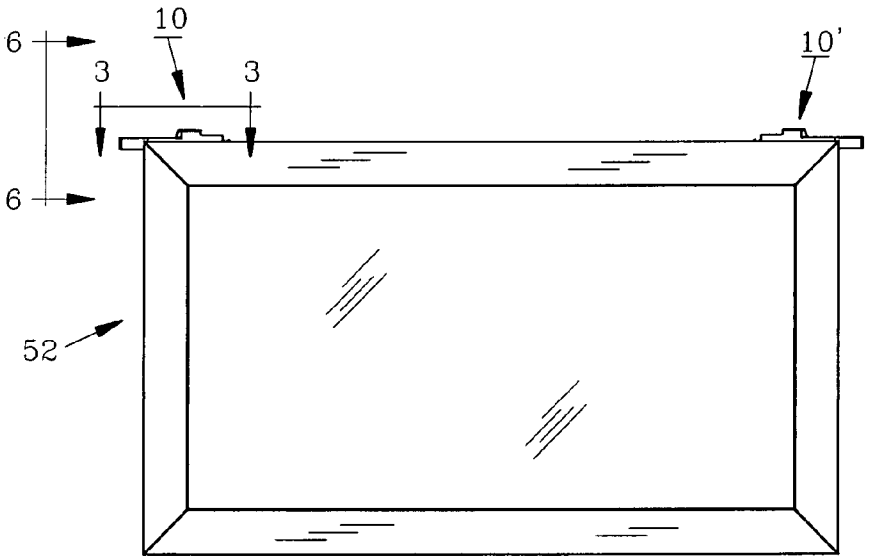
FIG. 2 demonstrates the sash as seen in FIG. 1 in an enlarged vertical position as removed from the window.
Figure 3:
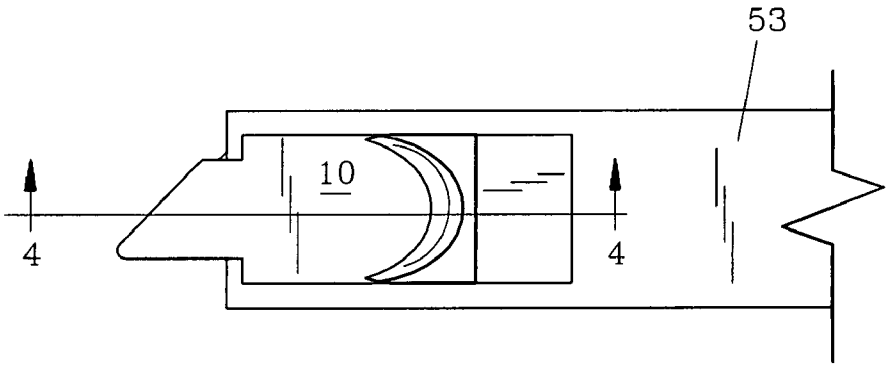
FIG. 3 illustrates a top fragmented view of the sash as along lines 3-3 of FIG. 2.

Sash 52 is shown in a front elevational view in FIG. 2 as removed from window 50 with tilt latches 10, 10' mounted thereon. FIG. 3 shows a top view of tilt latch 10 mounted in frame member 53 while FIG. 4 provides a cross-sectional view showing cavity 28 with spring 25 therein abutting rear edge 62 of groove 54 with projection 12 extending therefrom.

Figure 6A:
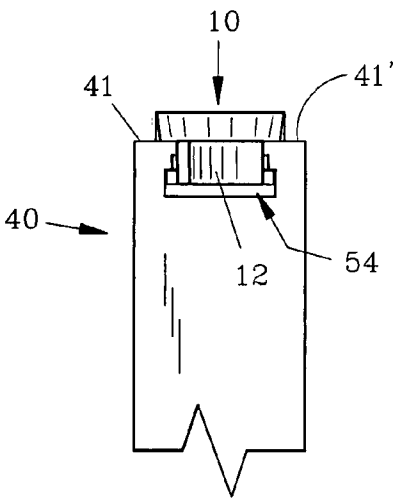
FIG. 6A shows a partial front view of the alternate sash seen in FIG. 5A.
Figure 5A:
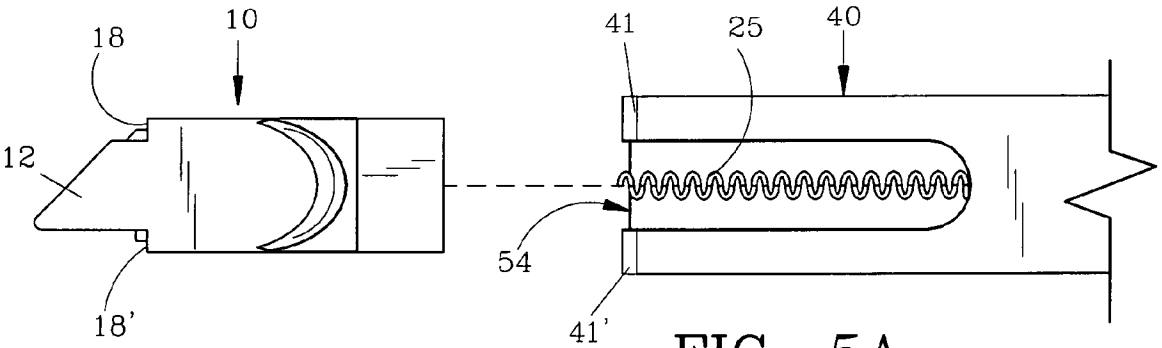
FIG. 5A pictures an alternate partial sash top view with latch gates.

Standard sash frame 40 seen only in partial view in FIGS. 5A and 6A has been modified by the addition of stops or gates 41, 41' along the front top of groove 54. Gates 41, 41' engage shoulders 18, 18' of upper cover 14 of tilt latch 10 to prevent removal from groove 54 during operation. Gates 41, 41' can be formed during sash manufacturing or can be added to a standard sash for extra durability and maintenance of latch 10 therein.

Figure 6:
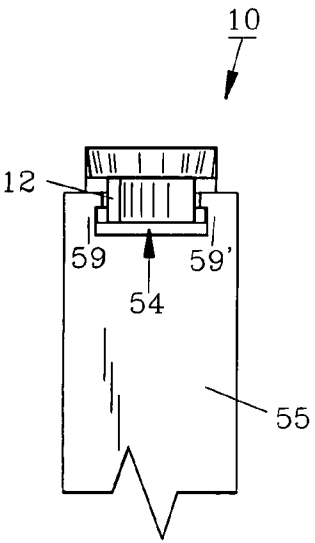
FIG. 6 demonstrates a front view of a section of the sash as along lines 6-6 of FIG. 5.
Figure 5:
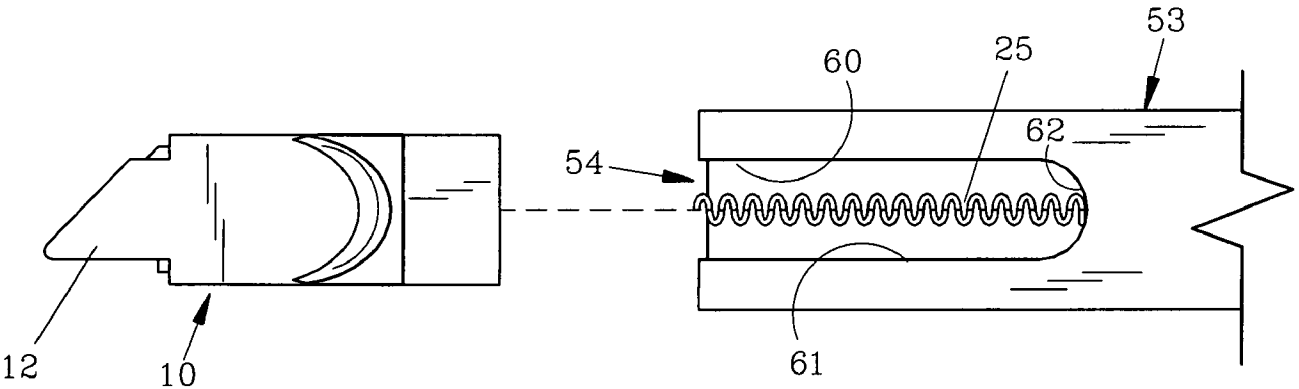
FIG. 5 depicts a partial enlarged top view of the sash as seen in FIG. 3 with the tilt latch exploded therefrom.
Figure 13:
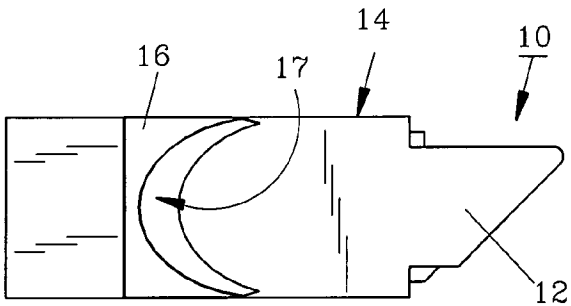
FIG. 13 pictures a top plan view of the tilt latch as shown in FIG. 7.

In FIG. 6 a front view of groove 54 is shown whereby front edges 59, 59' of side frame member 55 engage latch lower cover shoulders 19, 19' (FIG. 12) to stop, engage and maintain latch 10 within groove 54 which as understood, is normally urged outwardly by spring 25 (FIG. 5).

Figure 4:
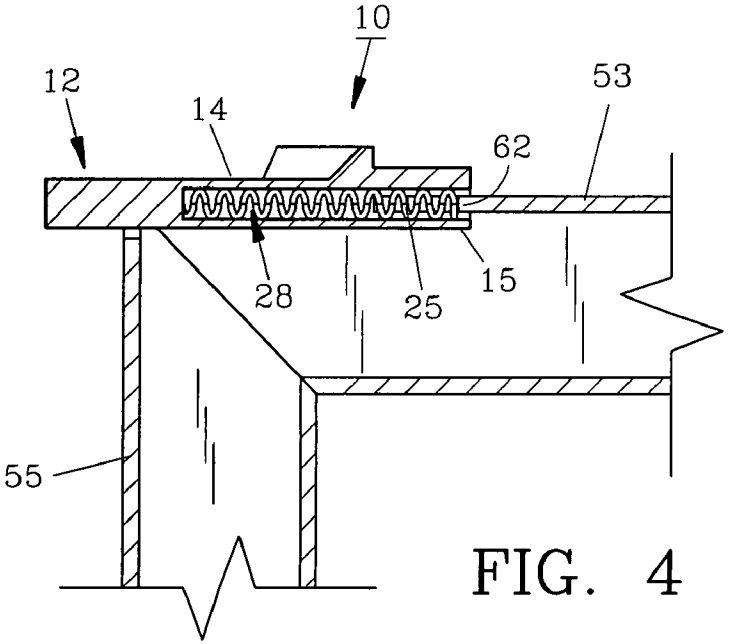
FIG. 4 features a cross-sectional view of a portion of the sash as shown along lines 4-4 as seen in FIG. 3.

Preferred coil spring 25 as shown in FIGS. 4 and 5 is in contact with rear edge 62 of groove 54 formed in upper frame member 53 to normally maintain an outward force on tilt latch 10 and force projection 12 into standard frame recess 57 positioned along the interior of vertical frame member 58 of window 50 as seen in FIG. 1 when sash 52 is closed. Other types of resilient members or springs, such as leaf springs could be used but are not preferred. Frame recesses 57, 57' respectively in vertical frame members 58, 58' as shown in FIG. 1 are conventional as used for standard tilt latches.

FIG. 7 shows a perspective view of preferred tilt latch 10 removed from window 50 with coil spring 25 exploded therefrom. Spring 25 is manually inserted into cavity 28 of body 13 as illustrated in FIG. 4. FIGS. 8-13 show various views of preferred tilt latch 10 as formed from a hard, durable plastic such as glass reinforced nylon but may be made from metals such as zinc, aluminum or alloys thereof. While only tilt latch 10 is described herein in detail, tilt latch 10' which is a mirror image of tilt latch 10 could similarly be described.

Figure 12:
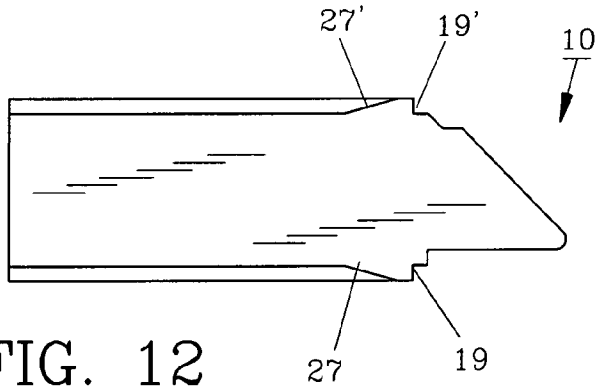
FIG. 12 illustrates a bottom plan view of the tilt latch as shown in FIG. 7.
Figure 11:
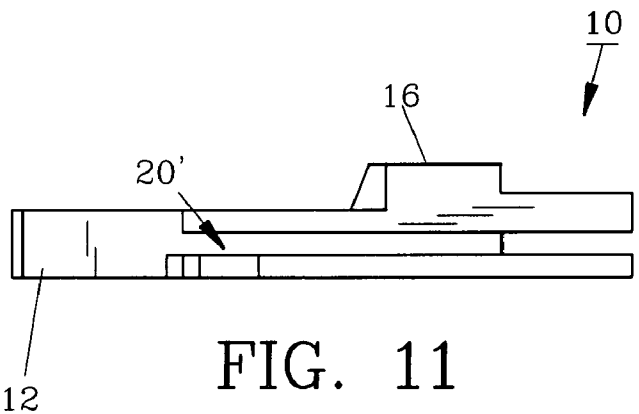
FIG. 11 demonstrates a left side elevational view of the tilt latch with the spring removed.
Figure 8:
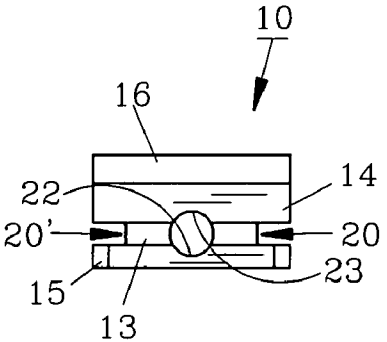
FIG. 8 pictures a rear view of the latch as seen in FIG. 7.
Figure 9:
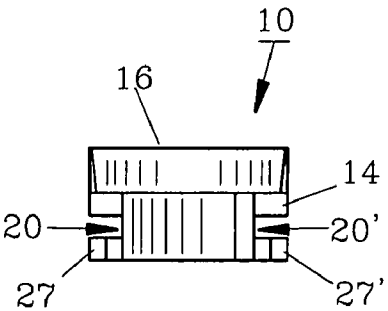
FIG. 9 depicts a front view of the tilt latch as seen in FIG. 7.

In FIG. 10 projection 12 is shown positioned forward of upper cover 14 and lower cover 15. The outer surfaces of covers 14 and 15 are coplanar with the top and bottom surfaces of projection 12 as seen in FIGS. 10 and 11. Shoulders 19, 19' of lower cover 15 as shown in FIG. 12 contact front edges 59, 59' of sash side frame member 55 (seen in FIG. 6) to engage and contain tilt latch 10 within groove 54 when sash 52 is opened as in FIG. 1. Top edges 60, 61 formed in upper frame member 53 and curved rear edge 62 (FIG. 5) surround groove 54 and fit between overhanging upper cover 14 and lower cover 15 as shown in FIGS. 8, 9 and 10 to guide tilt latch 10 in a linear direction along channels 20, 20' (FIGS. 8, 9 and 11) as it moves along groove 54. Upper cover 14 includes top finger tab 16 shown in FIGS. 7, 8, 9, 10, 11 and 13 with arcuate face 17 for easy gripping and manipulation of tilt latch 10.

Coil spring 25 fits within lower cover channel 22 and upper cover channel 23 as shown in FIGS. 7 and 8 to guide spring 25 therealong and to stabilize (prevent bowing) spring 25 once in place as shown in FIG. 10 as spring 25 rests in cavity 28 of body 13.

The preferred method of using tilt latch 10 includes the integral manufacture thereof by conventional molding techniques and once molded, spring 25 is manually inserted along channels 22, 23 into cavity 28 as seen in FIG. 10. Next, tilt latch 10 is inserted into a sash groove such as groove 54 as shown in FIGS. 5 and 6 by manually applying pressure to edges 59, 59' of frame member 55 to slightly spread them apart while compressing spring 25 against rear edge 62 of groove 54 as shown in FIGS. 4, 5 and 6. Ramps 27, 27' (FIGS. 9 and 12) help aid the insertion of latch 10 into groove 54. Lower cover shoulders 19, 19' prevent removal of latch 10 as shoulders 19, 19' engage 59, 59' of side frame member 55 as earlier described. Once tilt latches 10, 10' are so positioned window sash 52 mounted in window frame 52 (FIG. 1) can be pivoted and closed whereby tilt latch 10 engages recess 57 and tilt latch 10' engages recess 57' to securely hold sash 52 in a closed position within window frame 50.

The illustrations and examples provided herein are for explanatory purposes and are not intended to limit the scope of the appended claims.

I claim:

1. A tilt latch movably positioned in a window sash groove having an open end with rear and side edges, the sash retaining a tilting window in relation to a window frame member, said latch comprising: a body, said body defining: a projection, an upper cover and a lower cover, said projection and said upper cover in coplanar relation, said upper cover and said lower cover defining a channel therebetween for receiving the edges of the sash groove, a spring, and said spring in contact with said body and the rear edge of the window sash groove to urge said body from the window sash groove.

2. The tilt latch of claim 1 wherein said lower cover is coplanar with said projection, and a pair of ramps, said ramps positioned on said lower cover to assist latch entry into the sash groove.

3. The tilt latch of claim 1 wherein said body defines a spring cavity, said spring mounted in said spring cavity.

4. The tilt latch of claim 1 wherein said body, said projection, said upper cover and said lower cover are integrally formed to slide in unison with respect to the window sash.

5. The tilt latch of claim 1 wherein said tilt latch is formed from a polymeric material.

6. The tilt latch of claim 1 wherein said upper cover defines a shoulder, said shoulder proximate said projection.

7. A latch mounted in an open groove having rear and side edges of a tiltable window sash to engage a recess on the window frame to secure the sash in the frame, said latch comprising:

a unitary body, said body defining a projection, and upper and lower covers, said upper and said lower covers forming a channel therebetween for receiving an edge of the sash groove, a spring, said spring in contact with said body and abutting a rear edge of the groove, said spring biased to urge said body from said groove and into the window frame recess.

8. The latch of claim 7 further comprising a finger tab, said finger tab mounted on said upper cover.

9. The latch of claim 7 wherein said body defines a cavity, said spring positioned in said cavity, said cavity coplanar with said channel.

10. The latch of claim 7 wherein said body, said projection and said covers are integrally molded to slide in unison away from the rear edge of the groove.

11. The latch of claim 7 wherein said lower cover defines shoulders for engaging a side window frame member.

12. A latch in combination with a tiltable window sash, said sash comprising: a tubular member, said tubular member defining an open groove having side and rear edges;

said latch comprising: a body, said body defining a cavity, a spring, said spring positioned in said cavity, and abutting the rear edge of said sash groove, said body further defining a projection and upper and lower covers, said upper and said lower covers defining a channel therebetween, said channel engaging the side edges of said sash groove.

13. The combination of claim 12 wherein said upper cover defines a channel, said spring positioned in said upper cover channel.

14. The combination of claim 12 wherein said lower cover defines a channel, said spring positioned in said lower cover channel.

15. The combination of claim 12 wherein said upper and lower covers each define a shoulder.

16. The combination of claim 12 wherein said latch upper cover defines a shoulder, said window sash defining a stop, said latch shoulder for engaging said sash stop.

* * * * *